US012114777B2

(12) United States Patent
Shih et al.

(10) Patent No.: US 12,114,777 B2
(45) Date of Patent: Oct. 15, 2024

(54) FOLDABLE ELECTRIC BED

(71) Applicant: Chuan-Hang Shih, Lukang Township, Changhua County (TW)

(72) Inventors: Chuan-Hang Shih, Lukang Township, Changhua County (TW); Yu-Chi Yang, Lukang Township, Changhua County (TW)

( * ) Notice: Subject to any disclaimer, the term of this patent is extended or adjusted under 35 U.S.C. 154(b) by 0 days.

(21) Appl. No.: 17/561,098

(22) Filed: Dec. 23, 2021

(65) Prior Publication Data

US 2023/0200546 A1 Jun. 29, 2023

(51) Int. Cl.
*A47C 19/12* (2006.01)
*A47C 19/02* (2006.01)
*A47C 20/04* (2006.01)

(52) U.S. Cl.
CPC ..... *A47C 19/12* (2013.01); *A47C 20/041* (2013.01); *A47C 19/024* (2013.01)

(58) Field of Classification Search
CPC ..... A47C 19/12; A47C 20/041; A47C 19/024
USPC ..... 5/174
See application file for complete search history.

(56) References Cited

U.S. PATENT DOCUMENTS 1,363,956 A * 12/1920 Coopersmith ..... A47C 19/12 5/56
2,779,951 A * 2/1957 Travis ..... A47C 20/041 5/616
3,237,212 A * 3/1966 Hillenbrand ..... A61G 7/015 5/616
3,349,877 A * 10/1967 Downs ..... A61G 7/015 477/8
4,685,160 A * 8/1987 Rizzardo ..... A61G 7/015 5/285
5,329,657 A * 7/1994 Bartley ..... A47C 20/041 5/616
5,537,701 A * 7/1996 Elliott ..... A61G 7/015 5/616
5,640,730 A * 6/1997 Godette ..... A47C 20/041 5/617
6,101,647 A * 8/2000 Stroud ..... A47C 20/041 5/915
6,230,346 B1 * 5/2001 Branson ..... A61G 7/015 5/616
6,276,011 B1 * 8/2001 Antinori ..... A47C 20/08 5/613

(Continued)

FOREIGN PATENT DOCUMENTS

CN 210330038 U * 4/2020 ..... A47C 20/04

*Primary Examiner* — David R Hare
*Assistant Examiner* — Luke Hall
(74) *Attorney, Agent, or Firm* — Muncy, Geissler, Olds & Lowe, P.C.

(57) ABSTRACT

A foldable electric bed includes a base mount having a pivot portion, and a swivel mount pivotally connected with the pivot portion by a first shaft, such that the swivel mount is swivelable relative to the base mount between first and second positions due to the limit of first and second contact portions of the base mount. An actuator has a first end pivotally connected with the swivel mount by a second shaft, and a second end pivotally connected with a moveable frame such that the moveable frame is drivenable by the actuator to swivel relative to the base mount. When the swivel mount is swiveled from the first position to the second position, a position of the second shaft is lifted.

9 Claims, 6 Drawing Sheets

(56) References Cited

U.S. PATENT DOCUMENTS

2003/0052238 A1* 3/2003 Schneider ..... A47C 20/08 248/421
2004/0103476 A1* 6/2004 Barcesat ..... A47C 20/08 5/617
2006/0022500 A1* 2/2006 Roither ..... A47C 20/041 297/362
2008/0028535 A1* 2/2008 Rodrigues Moreira ..... A47C 20/041 5/722
2010/0313690 A1* 12/2010 Nielsen ..... A47C 20/041 74/102
2011/0271446 A1* 11/2011 Shih ..... A47C 20/041 5/174
2014/0053340 A1* 2/2014 Viberg ..... A47C 20/04 5/657
2014/0250600 A1* 9/2014 McCarty ..... A47C 20/041 5/617
2014/0259409 A1* 9/2014 Shih ..... A61G 7/002 5/600
2014/0366267 A1* 12/2014 Suh ..... A47C 20/041 5/174
2015/0033885 A1* 2/2015 Kristen ..... F16H 25/24 74/89.23
2015/0250323 A1* 9/2015 Goldsmith ..... A47C 19/12 5/11
2015/0313369 A1* 11/2015 Tarplee ..... A61H 23/0254 601/57
2016/0128883 A1* 5/2016 Robertson ..... A47C 7/50 5/613
2016/0353902 A1* 12/2016 Johnson ..... A47C 19/024
2017/0071356 A1* 3/2017 Xu ..... A47C 20/041
2017/0258239 A1* 9/2017 Xie ..... A47C 27/002
2017/0325592 A1* 11/2017 Suh ..... A47C 31/00
2017/0347807 A1* 12/2017 Totemeier ..... A47C 19/005
2018/0103770 A1* 4/2018 Nava ..... A61G 7/015
2018/0110665 A1* 4/2018 Totemeier ..... A61G 7/1096
2019/0021511 A1* 1/2019 Shih ..... A47C 20/041
2019/0223610 A1* 7/2019 Huai ..... A47C 19/005
2019/0298074 A1* 10/2019 Dan-On ..... A61G 7/018
2019/0298075 A1* 10/2019 Dan-On ..... A61G 7/015
2019/0307621 A1* 10/2019 Kim ..... A61G 7/005
2020/0375368 A1* 12/2020 Choi ..... A47C 20/04
2021/0321785 A1* 10/2021 Wang ..... A47C 21/00
2023/0000258 A1* 1/2023 Xiang ..... A61G 7/015

* cited by examiner

FOLDABLE ELECTRIC BED

BACKGROUND OF THE INVENTION

1. Field of the Invention

The present invention relates generally to an electric bed and more particularly, to a foldable electric bed that can be folded for convenient storage and/or transportation.

2. Description of the Related Art

Conventional electric bed has usually a bulky packing volume, resulting in difficulty in transportation thereof to the dealer and/or buyer. To solve the aforesaid problem, a foldable electric bed is developed to reduce the packing volume for transportation. However, owing to the internal structural design and the installation angles of components, the foresaid foldable electric bed still has an unsatisfied thickness, resulting in unsatisfied overall volume, and inconvenient storage and transportation. In other words, the conventional foldable electric bed needs to be improved.

SUMMARY OF THE INVENTION

The present invention has been accomplished in view of the above-noted circumstances. It is an objective of the present invention to provide a foldable electric bed, which can solve the problems of existing foldable electric beds, such as exceeding thickness, limited space-saving effect, and inconvenience in storage and transportation after the electric beds are folded.

To attain the above objectives, the present invention provides a foldable electric bed comprising a base mount, a swivel mount, a first moveable frame, and an actuator. The base mount comprises a pivot portion. The swivel mount is pivotally connected with the pivot portion by a first shaft, such that the swivel mount is swivelable relative to the base mount. The pivot portion is provided at a first side with a first contact portion and at a second side with a second contact portion. The swivel mount is swivelable between a first position where the swivel mount is directly in contact with the first contact portion, and a second position where the swivel mount is directly in contact with the second contact portion. The actuator has a first end pivotally connected with the swivel mount by a second shaft, and a second end pivotally connected with the first moveable frame, such that the moveable frame is drivenable by the actuator to swivel relative to the base mount. When the swivel mount is swiveled from the first position to the second position, an elevational position of the second shaft is upwardly lifted, thereby minimizing overall thickness of the electric bed in a folded state.

With the above-mentioned structural features, the angle of the swivel mount of the foldable electric bed can be adjusted to reduce the overall thickness of the foldable electric bed in the folded state, thereby achieving the effects of reducing packing volume, and convenient transportation and storage.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
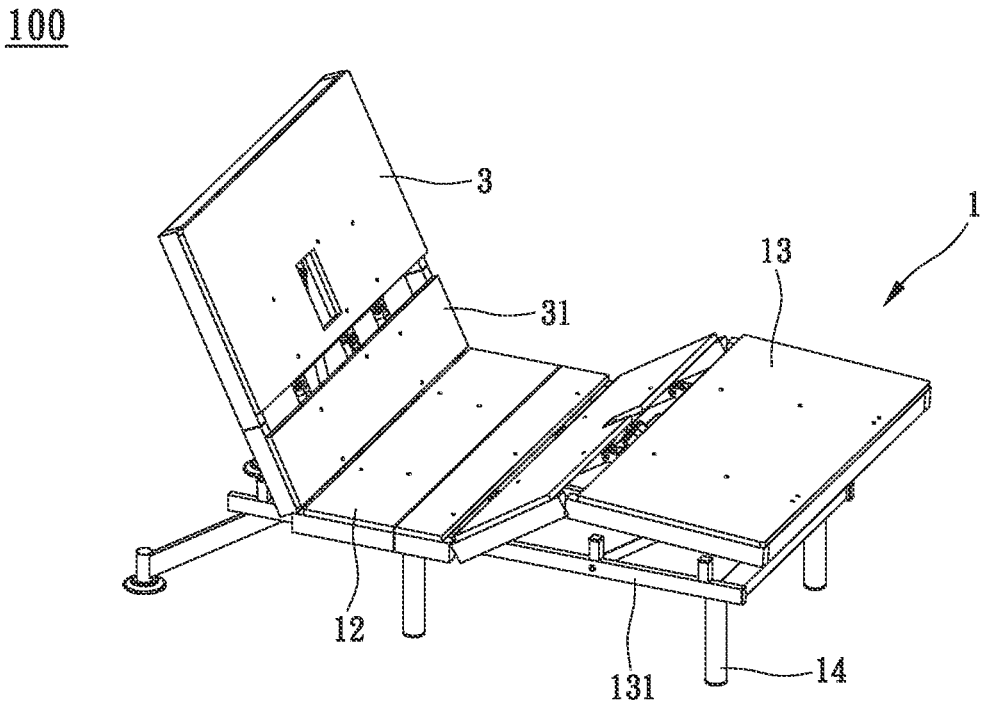
FIG. 1 is a perspective view of a foldable electric bed according to an embodiment of the present invention in a state of use.
Figure 2:
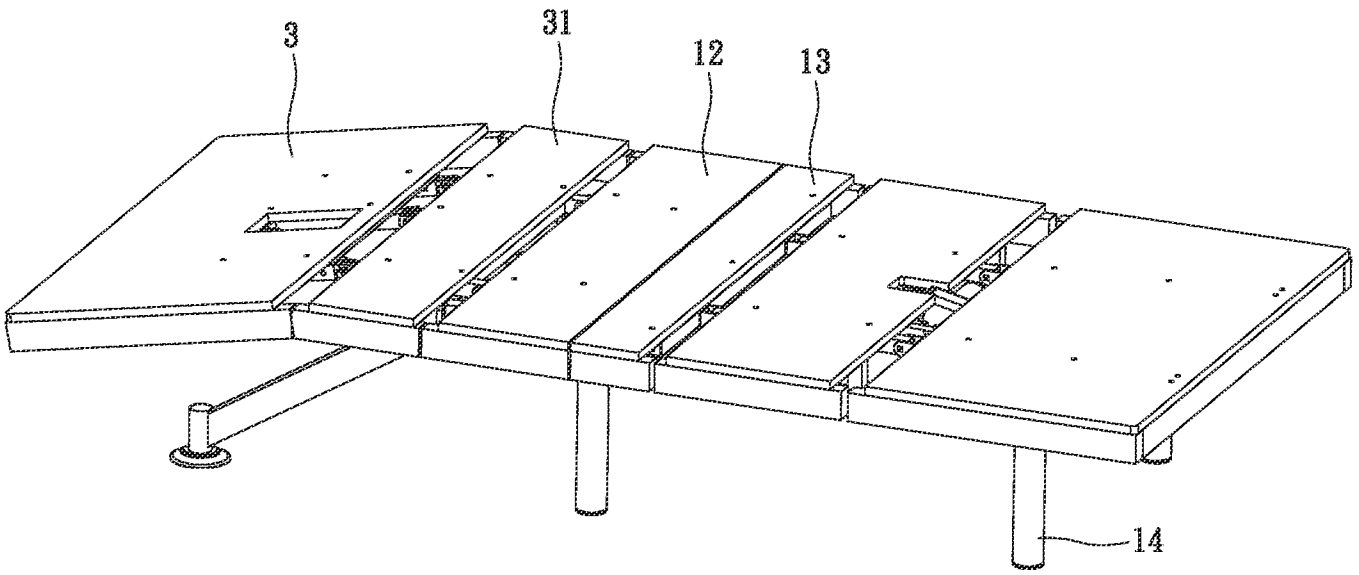
FIG. 2 is still another perspective view of the foldable electric bed of the embodiment of the present invention in another state of use.

The structure and technical features of the present invention will be detailedly described hereunder by an embodiment and accompany drawings. As shown in FIGS. 1-2, a foldable electric bed 100 provided in accordance with an embodiment of the present invention comprises a base mount 1, a swivel mount 2, a first moveable frame 3, a second moveable frame 31, and an actuator 4. The base mount 1 forms a structural foundation of the foldable electric bed 100. In this embodiment, the base mount 1 comprises a pivot portion 11, a front mount 12, a rear mount 13, and a plurality of support legs 14. The front mount 12 is composed of a support frame 121 and a plate 122 disposed on the support frame 121. The plate 122 may be encased by soft pad (not shown). The structural arrangements of the rear mount 13, the first moveable frame 3 and the second moveable frame 31 are similar to the structural arrangement of the front mount 12. However, the front mount 12, rear mount 13, first moveable frame 3 and the second moveable frame 31 may be provided with no such plate 122 as long as the tops of them can be constructed with support planes for supporting a mattress thereon. The support frame 121 of the front mount 12 and the support frame 131 of the rear mount 13 are pivotally connected with each other. The support legs 14 are mounted to the bottoms of the support frames 121 and 131 of the front and rear mounts 12 and 13. In another embodiment of the present invention, the support legs 14 may be omitted, such that the foldable electric bed 100 can be directly placed on a plane, such as ground or a top plane of a bed frame, for use.

Figure 1A:
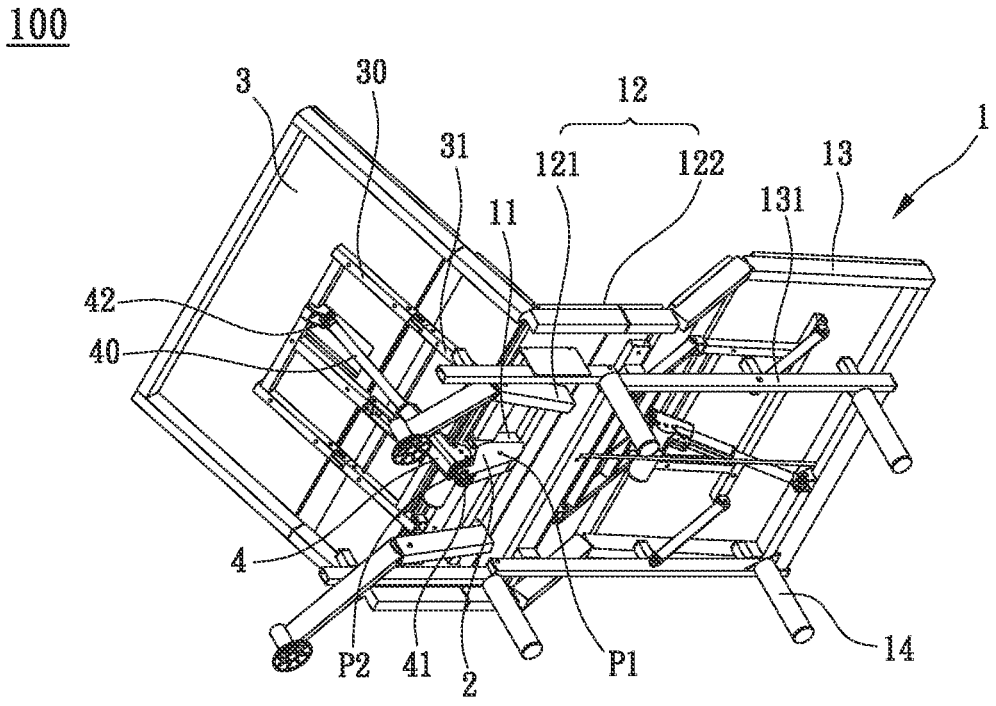
FIG. 1A is another perspective view of the foldable electric bed of the embodiment of the present invention.

Referring to FIG. 1A, the swivel mount 2 of the foldable electric bed 100 is pivotally connected with the pivot portion 11 by a first shaft P1, such that the swivel mount 2 is swivelable relative to the base mount 1. In this embodiment, the pivot portion 11 is fixedly mounted to a bottom of the support frame 121 of the front mount 12. The actuator 4 is an electric cylinder, pneumatic cylinder or hydraulic cylinder having a telescopic rod 40, and is provided with a first end 41 and a second end 42. The first end 41 is pivotally connected with the swivel mount 2 by a second shaft P2, and the second end 42 is pivotally connected with the first moveable frame 3, such that the first moveable frame 3 is drivenable by the actuator 4 to swivel relative to the base mount 1.

Specifically, in this embodiment, the first moveable frame 3 is adapted for supporting the head of a user, and the second moveable frame 31 is adapted for supporting the back of the user. The second moveable frame 31 has an end, namely the rear end close to the tail of the bed, is pivotally connected with the front mount 12 of the base mount 1, and the other end, namely the front end close to the head of the bed, is pivotally connected with the first moveable frame 3. As such, under a posture that the first and second moveable frames 3 and 31 are parallel to each other and located on a same plane, the first and second moveable frames 3 and 31 can concurrently and upwardly swivel relative to the front mount 12 of the base mount 1 to support the upper body of the user. In another aspect, as shown in FIG. 2, the first moveable frame 3 can also independently swivel relative to the second moveable 31 and the base mount 1 so as to adjust the support location on which the head of the user lies.

In another embodiment of the present invention, the foldable electric bed 100 may not comprise the second moveable frame 31. In this case, an end of the support frame 30 of the first moveable frame 3 is directly and pivotally connected with the support frame 121 of the front mount 12, such that the first moveable frame 3 can be driven by the actuator 4 to swivel up and down relative to the front mount 12 of the base mount 1.

In still another embodiment of the present invention, the pivot portion 11 is fixedly mounted to the support frame 131 of the rear mount 13, the first moveable frame is adapted for supporting thighs of a user, and an end of the support frame of the first moveable frame is pivotally connected with the pivot portion 11. As such, the first moveable frame can be driven by the actuator 4 to swivel up and down relative to the rear mount 13 of the base mount 1.

Figure 3:
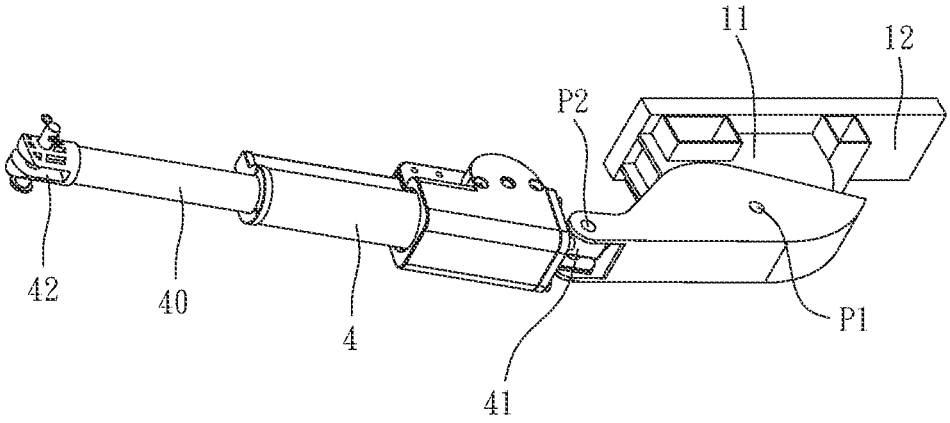
FIG. 3 is a schematically perspective view of a part of the foldable electric bed of the embodiment of the present invention.
Figure 3A:
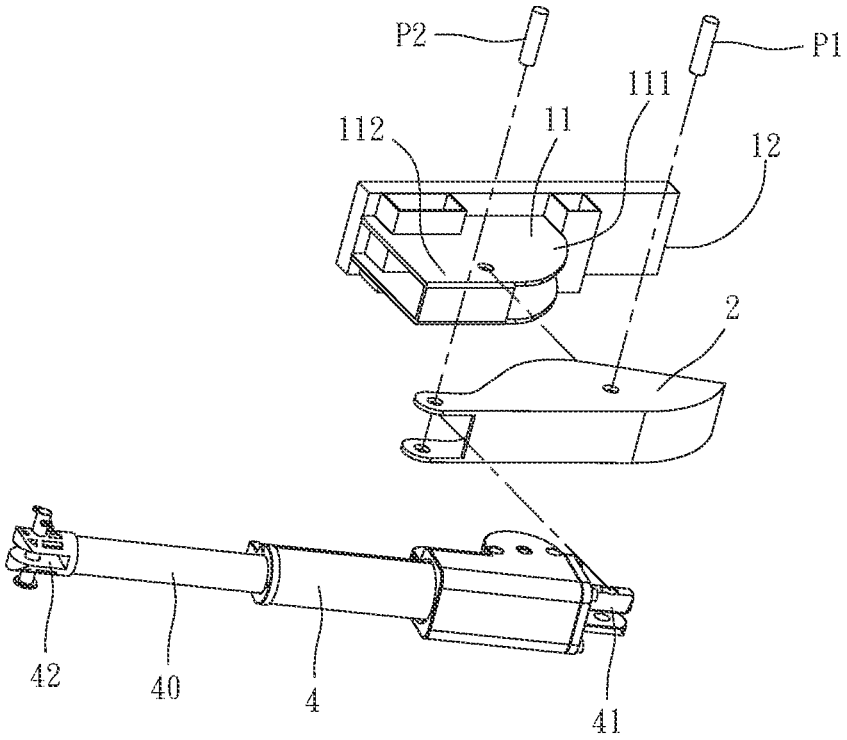
FIG. 3A is an exploded view of the part shown in FIG. 3.

Referring to FIGS. 3 and 3A, in this embodiment, the pivot portion 11, which is mounted to the front mount 12 that is partially shown in FIGS. 3 and 3A, is provided at different sides thereof, namely first and second sides, with first and second contact portions 111 and 112, respectively. The first shaft P1 is located between the first contact portion 111 and the second shaft P2, and the second contact portion 112 is located between the first shaft P1 and the second shaft P2. An elevational position of the first contact portion 111 is higher than an elevational position of the second contact portion 112 when the foldable electric bed is normally used and placed on a normal position. As shown in FIG. 3A, the first contact portion 111 is formed by at least one curved surface at a rear side of the pivot portion 11, and the second contact portion 112 is a horizontal surface at a bottom side of the pivot portion 11. However, the shapes of the first and second contact portions 111 and 112 are not limited to the ones disclosed in this embodiment. They may be modified in accordance to the shape of the swivel mount 2, and may be configured as being any stop structures that can provide position-limiting effect. For example, the first contact portion may be formed by a horizontal surface extending from the rear side of the pivot portion, and the second contact portion may be formed by a curved surface or a protrusion at the bottom side of the pivot portion.

Figure 4:
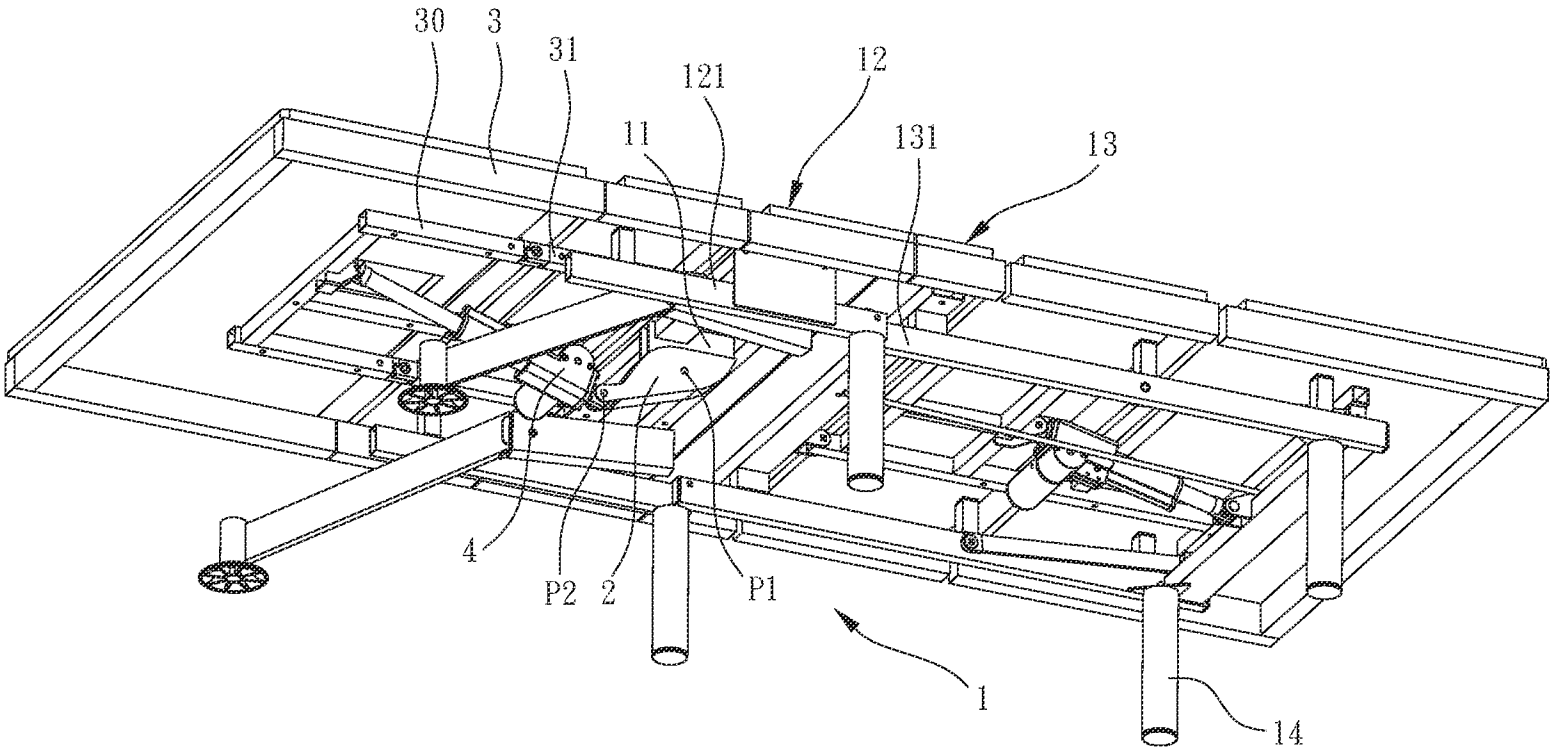
FIG. 4 is still another perspective view of the foldable electric bed of the embodiment of the present invention in a horizontal state of use.
Figure 4A:
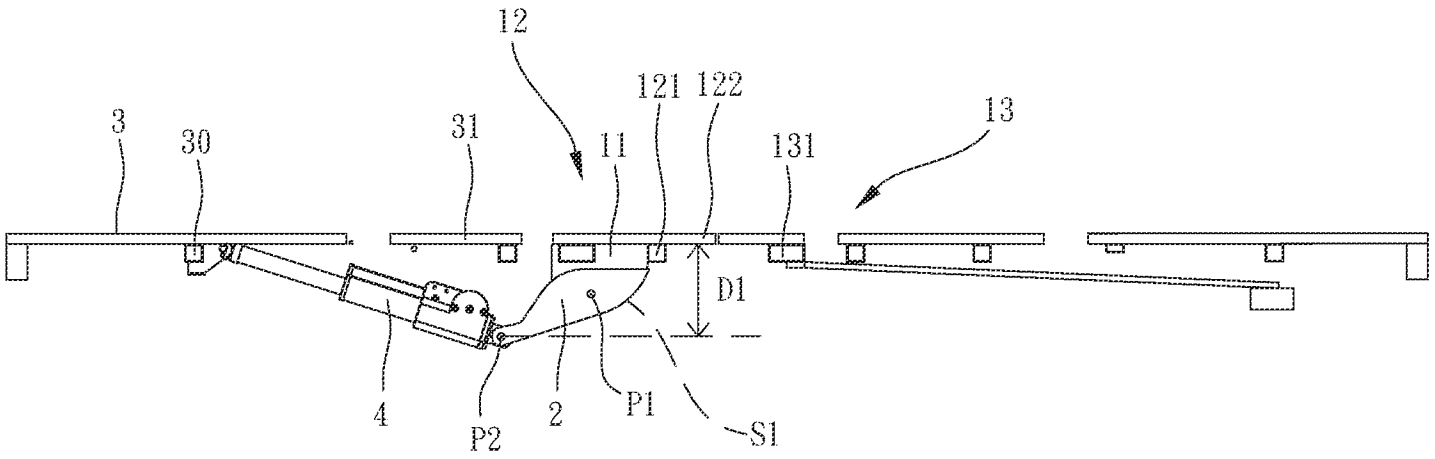
FIG. 4A is a schematic view showing a part of the foldable electric bed in FIG. 4.
Figure 5:
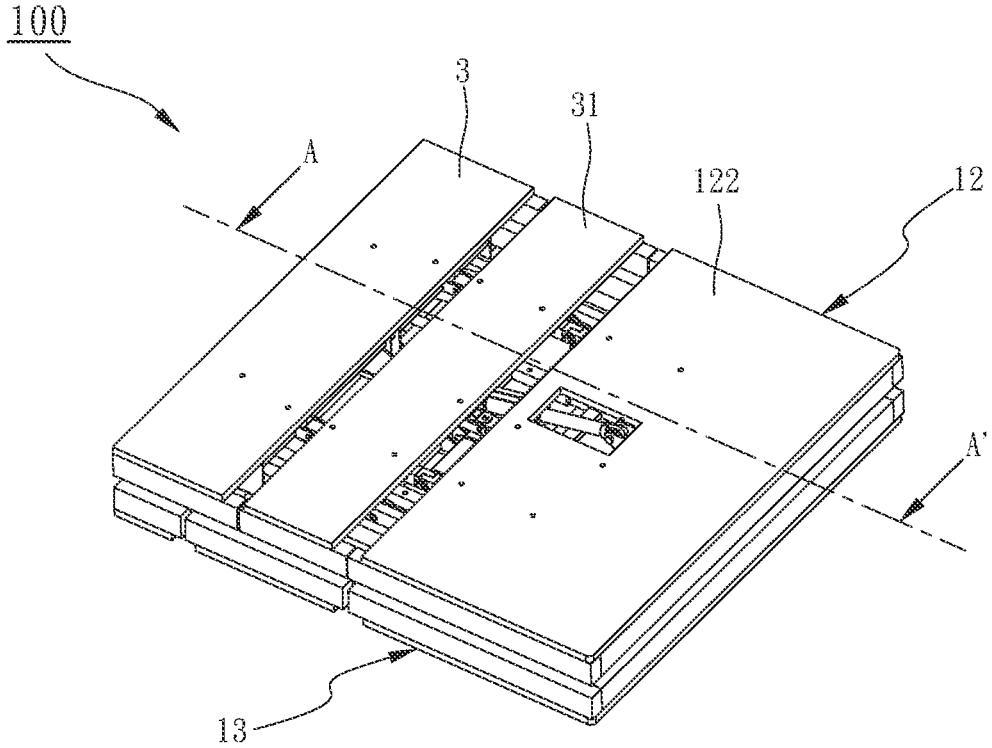
FIG. 5 is still another perspective view, showing that the foldable electric bed of the embodiment of the present invention is folded.
Figure 5A:
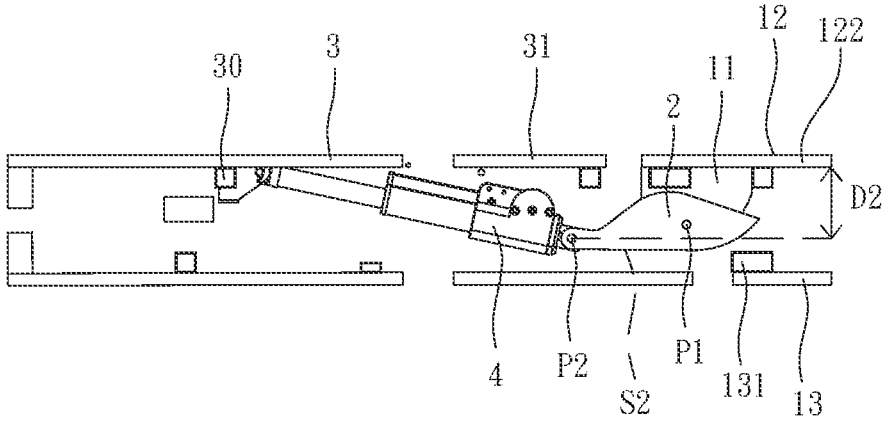
FIG. 5A is a schematically sectional view taken along line A-A' and showing only a part of the foldable electric bed.

Referring further to FIGS. 4 to 5A and FIG. 3A, by means of the position-limiting effect provided by the first and second contact portions 111 and 112 of the pivot portion 11, the swinging motion of the swivel mount 2 is limited within the range between a first position S1 and a second position S2. As shown in FIGS. 4 and 4A, when the swivel mount 2 is stayed at the first position S1, the swivel mount 2 is directly in contact with the first contact portion 111 of the pivot portion 11. As shown in FIG. 5A, when the swivel mount 2 is stayed at the second position S2, the swivel mount 2 is directly in contact with the second contact portion 112 of the pivot portion 11.

It is to be particularly illustrated that when the swivel mount 2 is swiveled from the first position S1 to the second position S2, an elevational position of the second shaft P2 is upwardly lifted, such that the second shaft P2 shown in FIG. 5A will be close to the front mount 12 than the second shaft P2 shown in FIG. 4A is. In other words, at this mount, a vertical distance D2 between the second shaft P2 and the plate 122 of the front mount 12, as shown in FIG. 5A, will be shorter than the vertical distance D1 between the second shaft P2 and the plate 122 of the front mount 12 when the swivel mount 2 is swiveled to and stayed at the first position S1 as shown in FIG. 4A. As such, the overall thickness of the foldable electric bed 100 in the folded state can be reduced, thereby solving the problems of exceeding thickness and inconvenience in storage and transportation of the conventional foldable electric bed in the folded state so as to attain the objective of the present invention.

In conclusion, because the foldable electric bed 100 of the present invention is provided with the swivel mount 2 that can swivel relative to the base mount 1 for installation of the actuator 4, the elevational position of the second shaft P2 can be adjusted to be closer to the base mount 1, resulting in that the foldable electric bed 100, after it is folded, will have a thin overall thickness and a reduced packing volume. Compared to the conventional structure, the foldable electric bed 100 of the present invention provides the advantageous effects of reduced packing volume and convenience in transportation and storage.

Based on the technical features of the present invention, various modifications to the foldable electric beds 100 may be made. For example, the base mount 1 may be configured as one single structure extending from head to tail of the bed without distinction of the front and rear mounts as long as the technical feature of the swivel mount 2 is adopted. Such variations are not to be regarded as a departure from the spirit and scope of the invention, and all such modifications as would be obvious to one skilled in the art are intended to be included within the scope of the following claims.

What is claimed is:

1. A foldable electric bed, comprising:

a base mount;

a swivel mount pivotally connected with the base mount by a first shaft, such that the swivel mount is swivelable relative to the base mount;

a first moveable frame; and an actuator having a first end pivotally connected with the swivel mount by a second shaft, and a second end directly pivotally connected with the first moveable frame, such that the first moveable frame is drivenable by the actuator to swivel relative to the base mount;

wherein the base mount comprises a pivot portion, to which the first shaft is disposed; the pivot portion is provided at a first side with a first contact portion and at a second side with a second contact portion; the swivel mount is swivelable between a first position where the swivel mount is directly in contact with the first contact portion, and a second position where the swivel mount is directly in contact with the second contact portion.

2. The foldable electric bed as claimed in claim 1, wherein the first shaft is located between the first contact portion and the second shaft, and the second contact portion is located between the first shaft and the second shaft.

3. The foldable electric bed as claimed in claim 1, wherein when the swivel mount is swiveled from the first position to the second position, a position of the second shaft is upwardly lifted.

4. The foldable electric bed as claimed in claim 1, wherein an elevational position of the first contact portion is higher than an elevational position of the second contact portion.

5. The foldable electric bed as claimed in claim 4, wherein the second contact portion is a horizontal surface.

6. The foldable electric bed as claimed in claim 1, wherein the base mount comprises a front mount and a rear mount pivotally connected with the front mount.

7. The foldable electric bed as claimed in claim 6, wherein the base mount comprises a plurality of support legs mounted to the front mount and the rear mount.

8. The foldable electric bed as claimed in claim 1, wherein the first moveable frame has an end pivotally connected with the base mount.

9. The foldable electric bed as claimed in claim 1, comprising a second moveable frame having two ends pivotally connected with the base mount and the first moveable frame, respectively.

* * * * *